United States Patent [19]

Lindgren

[11] 4,435,250

[45] Mar. 6, 1984

[54] DEVICE FOR ADJUSTING THE POSITION OF A TRACK MOUNTED CAR

[75] Inventor: Carl Lindgren, Glenshaw, Pa.

[73] Assignee: Koppers Company, Inc., Pittsburgh, Pa.

[21] Appl. No.: 375,445

[22] Filed: May 6, 1982

[51] Int. Cl.[3] ..... B61B 12/00; B61L 3/02; B61L 27/04; C10B 45/00

[52] U.S. Cl. ..... 202/239; 33/1 Q; 104/1 R; 202/262; 202/270; 364/426; 414/401; 414/750

[58] Field of Search ..... 202/239, 262, 270; 414/396, 401, 584, 750; 364/426; 33/1 Q; 104/1 R

[56] References Cited

U.S. PATENT DOCUMENTS

| | | | |
|---|---|---|---|
| 2,589,231 | 3/1952 | Drake . | |
| 2,730,707 | 1/1956 | Habeerle et al. . | |
| 2,760,270 | 8/1956 | Sims . | |
| 2,972,422 | 2/1961 | Stone . | |
| 3,017,622 | 1/1962 | Horsfall . | |
| 3,254,512 | 8/1973 | Kmety | 414/584 |
| 3,451,898 | 6/1969 | Lo Presti et al. . | |
| 3,734,539 | 5/1973 | Salmi . | |
| 3,921,830 | 11/1975 | Bright | 202/262 |
| 4,049,501 | 9/1977 | Lindgren | 202/239 |
| 4,072,885 | 2/1978 | Emark | 202/262 |
| 4,196,471 | 4/1980 | McClure | 364/426 |
| 4,336,107 | 6/1982 | Irwin | 202/262 |

FOREIGN PATENT DOCUMENTS

| | | | |
|---|---|---|---|
| 595766 | 2/1978 | U.S.S.R. | 364/426 |
| 912747 | 3/1982 | U.S.S.R. | 202/270 |

*Primary Examiner*—Bradley Garris

*Attorney, Agent, or Firm*—Daniel J. Long; Herbert J. Zeh, Jr.

[57] ABSTRACT

A device for adjusting the position of a track mounted car from a first position where the car is initially spotted by conventional braking means to a second predetermined position on the track which must be reached within close tolerances. An arm which may be pivoted in a vertical arc parallel to the track is pivotally attached to the car at its one end and at its other end it has preferably cone-shaped feeler means which engages a protrusion fixed adjacent to the track. A preferably vertical gravity based reference position is selected for the arm, and a sensing means for producting a direct current output signal proportional in magnitude to angular displacement of the arm from this position and corresponding in polarity to direction of displacement is provided. This signal is inputed to a control means for a dual directional, variable speed hydraulic traction drive means for the car so it will move in the direction of its predetermined final position at an instantaneous velocity which is proportional to its distance from that position. In another embodiment of this invention, a protrusion is engaged by a horizontal arm which swings in a horizontal arc and interacts with a pivoting vertical arm which swings in a vertical arc parallel to the track. The sensing means is mounted on the vertical arm, and, as the horizontal arm is moved in becoming aligned with the protrusion, it displaces the vertical arm from its gravity based reference position so as to produce a signal to control the car's drive means.

26 Claims, 12 Drawing Figures

DEVICE FOR ADJUSTING THE POSITION OF A TRACK MOUNTED CAR

BACKGROUND OF THE INVENTION

1. Field of the Invention

The present invention relates to devices for stopping rail mounted cars, carriages or the like at preselected positions and, in particular, to devices for controlling the movement of coke oven machinery whereby such machinery is accurately stopped at preselected locations within close tolerance limits.

2. Description of the Prior Art

The need to provide a means for accurately stopping rail mounted cars at certain preselected locations is one that is common to a number of industries. On coke ovens, for example, various types of rail mounted auxilliary equipment must be spotted then aligned with certain track side structures to carry out charging, pushing door removal and like functions. After such equipment has been initially spotted, it is often necessary to adjust its position relative to a charging hole, a coke oven door or some other track side structure. This alignment is often done visually by the operator, but recently various devices have been proposed to improve the accuracy, reliability or speed of this procedure. U.S. Pat. No. 4,196,471, for example, discloses a coke oven machinery, positioning and spotting system, in which system characteristics are mapped in a process memory and system dynamics are controlled by a central processing unit and a sensing mode. While this system provides highly accurate control of machine travel and positioning, it has been recognized that in some instances the use of a less complex and costly alignment device might be appropriate. Such a device is disclosed in U.S. Pat. No. 4,049,501. This device includes an alignment bar which is mounted at a selected position on a coke oven and a support rod which is mounted on a piece of coke oven machinery. Attached to the end of this support rod there is a coaxial tubular housing in which a feeler arm is mounted to pivot on its vertical axis. A portion of this feeler arm extends outwardly from inside the tubular housing and has at its terminal end a means for engaging the alignment bar. The device also includes electrical contactors positioned oppositely in the tubing and means for resiliently biasing the feeler with respect to the tubular housing. If the machine is properly spotted within a preselected spotting tolerance, the alignment bar will be directly aligned with the feeler arm so that the feeler arm will not pivot about its vertical axis. If, however, the machine has not been spotted with the desired degree of accuracy, the feeler arm will pivot so that a metallic probe attached to it will contact one of the electrical contactors. The probe and contactors are connected in electrical circuit with bidirectional means for moving the machine so that the machine is moved in the appropriate direction to effect alignment until the metallic probe comes out of contact wtih the electrical contactors, at which time alignment would ideally be achieved. It is found, however, that in using this device the speed of the machine will be relatively constant regardless of how far the machine needs to be moved to be correctly positioned. Thus, the machine may initially overshoot its intended stopping position and may then oscillate back and forth over this position before finally coming to rest. It is, therefore, the object of the present invention to provide a device for accurately stopping a piece of track mounted equipment at a particular position so as to avoid such oscillation about that position.

SUMMARY OF THE INVENTION

The present invention is a device for adjusting the position of a car mounted on a track from a first position where the car is initially stopped by conventional spotting and braking means to a second position to where the car need be displaced, usually with a relatively high degree of accuracy. A usually downwardly extending arm is pivotally mounted so as to swing in a vertical arc which is parallel to the track and is also engageable with a protrusion fixed in relation to the track. Preferably, this arm will be at the terminal end of a hydraulic piston and cylinder which is pivotally attached to the car so that the arm may be withdrawn when not in use for positioning purposes. A gravity based reference position in this arc, which is preferably the vertical position, is chosen and a sensing device is connected to the arm to provide a preferably direct current electrical signal which is proportional in amplitude to the angular displacement of the arm from the reference position and is indicative, by polarity, of the side of the reference position to which the arm is displaced. This electrical signal is inputed to a control means for a dual directional, variable speed hydraulic traction drive for the car so that the direction of this drive will be dependent upon the polarity of this signal and speed will be proportional to amplitude. The instantaneous velocity of the car will, therefore, be approximately proportional to the distance at which the car is instantaneously displaced from its final position so that undue oscillation about this position will be avoided. In another embodiment of this invention, a protrusion is engaged by a horizontal arm which swings in a horizontal arc and interacts with a pivoting vertical arm which swings in a vertical arc parallel to the track. The sensing means is mounted on the vertical arm, and, as the horizontal arm is moved in becoming aligned with the protrusion, it displaces the vertical arm from its gravity based reference position so as to produce a signal to control the car's drive means.

BRIEF DESCRIPTION OF THE DRAWINGS

The present invention is further described in the accompanying drawings in which.

DETAILED DESCRIPTION

Figure 1:
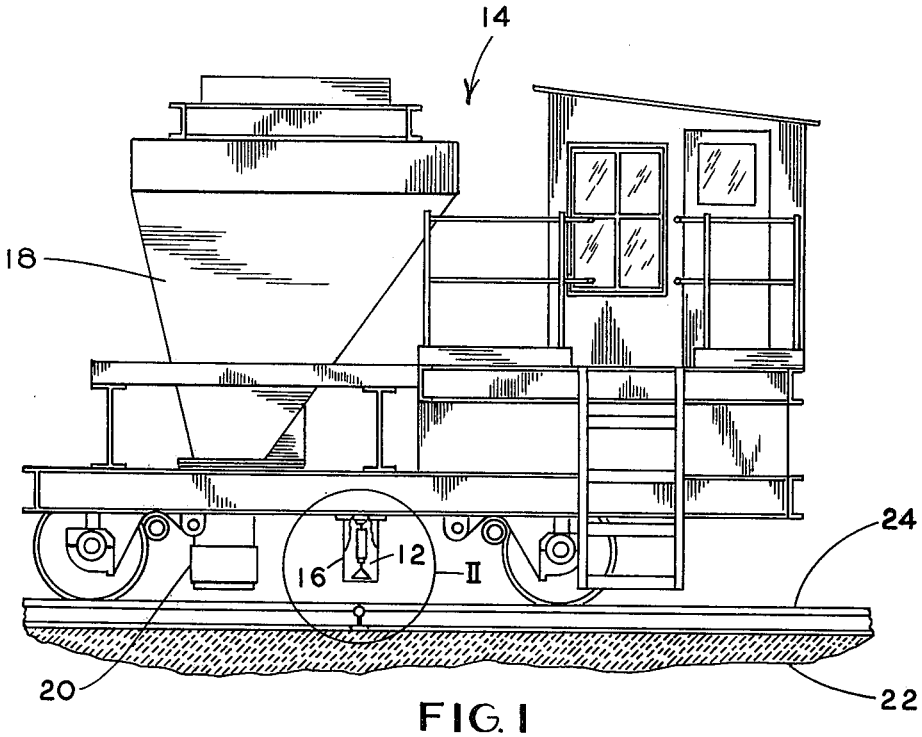
FIG. 1 is a side elevational view of a preferred embodiment of the position adjusting device of the present invention as it may be mounted for use on a coke oven charging car.
Figure 2:
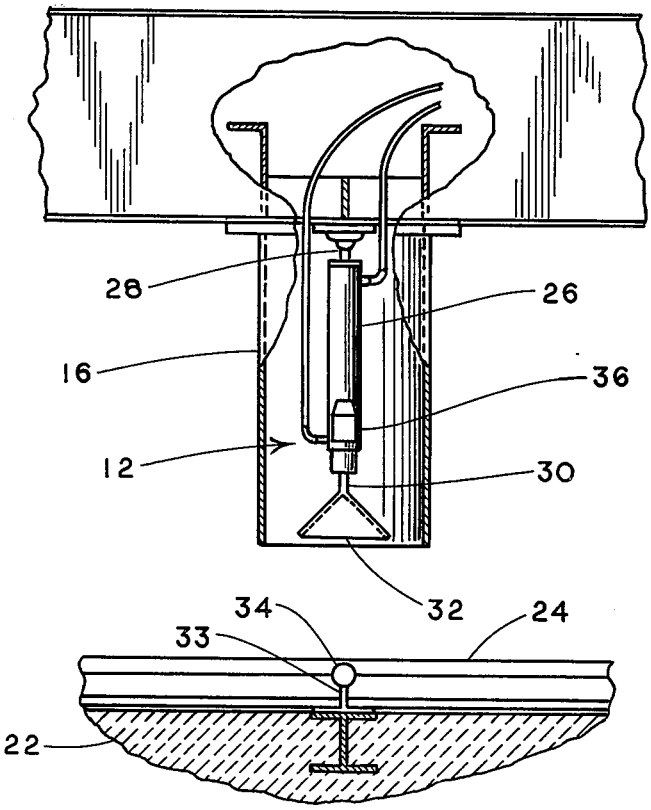
FIG. 2 is an enlaraged view of the area within Circle II in FIG. 1.
Figures 3A, 3B, 3C, 3D, 3E, 3F, 3G, 3H:
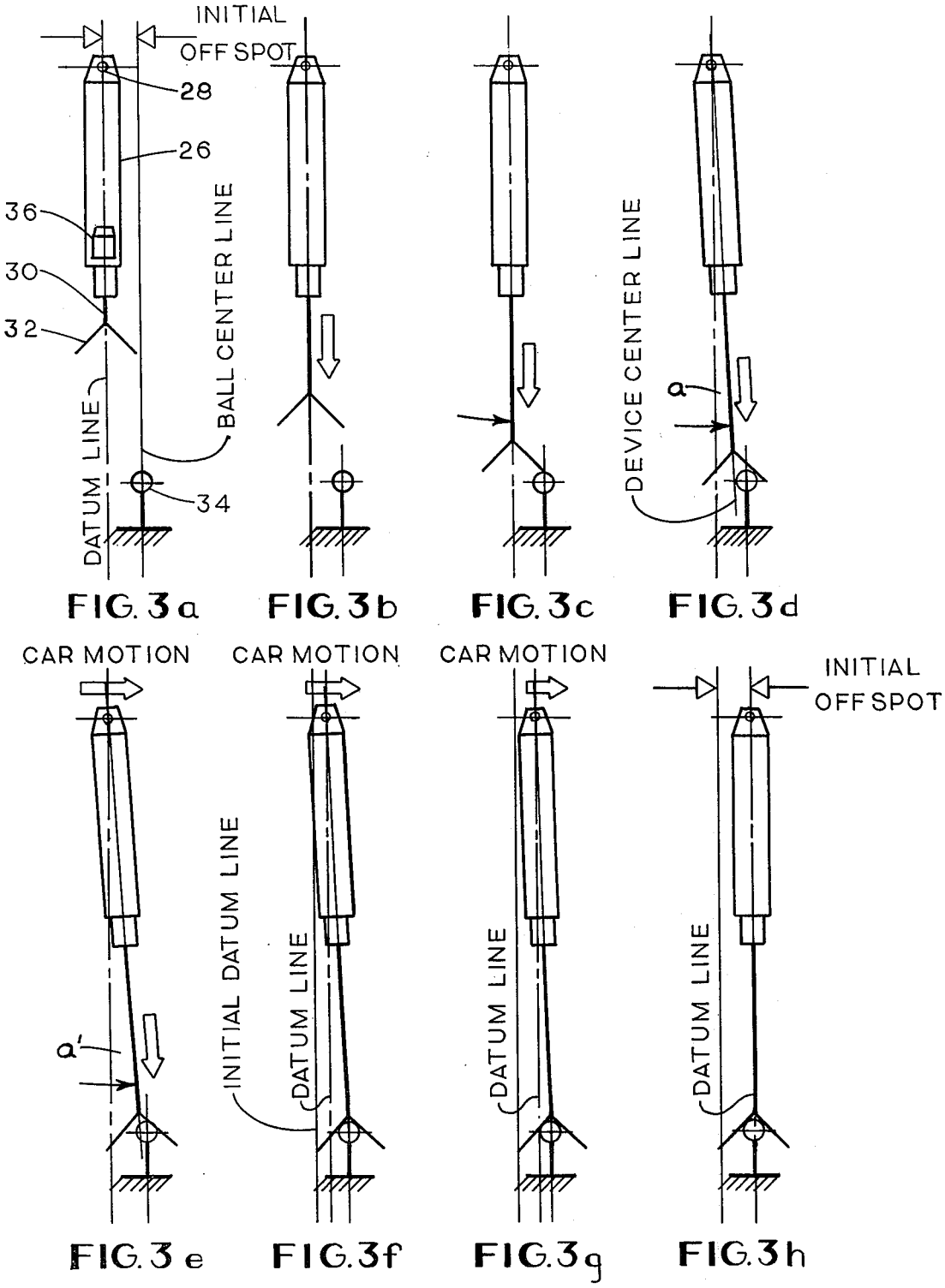
FIGS. 3*a*–3*h* are schematic diagrams illustrating the operation of the aligning device shown in FIG. 1.

Referring to FIGS. 1 and 2, the position adjusting device of the present invention is shown generally at numeral 12. It will be observed that this alignment device is suspended to extend downwardly from a coke oven charging car which is shown generally and in fragment at numeral 14. The position adjusting device is preferably mounted inside a vertical tube-shaped protecting structure which is shown cut away at one side at numeral 16. One or more conical, gravity operated hoppers as at 18 with closeable bottom discharge openings are mounted on the charging car. These hoppers are filled with coal, and have drop sleeves as at 20 telescoped on their lower extensions. This coke oven charging car travels on rails across a coke oven battery top shown, in fragment, at numeral 22. One rail on which the car travels is shown in fragment at numeral 24. As is known in the art, the charging car traverses the battery top until the bottom discharge openings of its hoppers are each aligned with charging holes (not shown) in the battery top. The drop sleeves on these hoppers are then lowered after which their loads of coal are discharged through the charging hole into the ovens below. To avoid spillage of this coal it is important that the charging car be precisely positioned so that the discharge opening will be satisfactorily aligned with the charging holes. Referring particularly to FIG. 2, it will be seen that the position adjusting device 12 consists of a hydraulic piston and cylinder combination 26 which is upwardly connected to the charging car 14 by means of a spherical bearing 28. Below the hydraulic piston and cylinder combination 26 there is an arm 30 which is extended as the piston and cylinder combination is expanded and withdrawn as it is compressed. At the terminal end of the extendable arm 30 there is a concave conically-shaped feeler element 32. The feeler element 12 is engageable with a feeler engagement means 33 that projects upwardly from the battery top and has at its upper terminal end a ball member 34. The feeler engagement means 33 is positioned so that when its vertical centerline corresponds with that of the arm of the position adjusting device the discharge openings of the hoppers will be aligned with the charging holes. Attached to the piston and cylinder combination, there is a level sensor device 36 which provides an output direct current electrical signal proportional to angular displacement of the sensor relative to a usually vertical, gravity based reference which will preferably be the longitudinal centerline of the position adjusting device as it is initially suspended from the car in the manner shown in FIG. 1. This reference line will, with reference to this embodiment of the present invention, be referred to as the "datum line". The level sensor device 36 will be fixed to the position adjusting device 12 so that its displacement from the datum line will be the same as the angular displacement of the longitudinal centerline of the device from the datum line. It will be understood that the frame of reference in which the datum line is defined is that of the car. Thus, this line moves with the car. The operation and components of this level sensor are described in greater detail below. A level sensor which is suitable for use with the device of the present invention is available from Moog Inc. of East Aurora, N.Y. and is designated as Model 133–102.

The operation of the alignment device 12 is illustrated in FIGS. *3a–3h*. The charging car is initially spotted by its operator so that the feeler cone element 32 is aligned with the feeler engagement ball 34 as is shown in FIG. *3a*. In this spotting, it is only necessary that some part of the cone be superimposed over the feeler engagement ball. The piston and cylinder combination 26 is then expanded, as is shown in FIG. *3b* to extend the arm 30. Such extension of the arm 30 will continue until the feeler cone comes into contact with the feeler engagement ball as is shown in FIG. *3c*. The hydraulic piston and cylinder combination will continue to expand and further extend the arm so as to move the feeler engagement ball across the inner surface of the cone and pivot the piston and cylinder combination on the spherical bearing until the feeler engagement ball comes to rest in the central portion of the feeler cone as is shown in FIG. *3f*. It will be observed from FIG. *3d* that a displacement angle a is established between the datum line and the device centerline. A null angle will also be defined as the largest displacement angle which will not result in an adjustment of the car's position. In other words, as long as the displacement angle is equal to or less than the null angle, as it is in FIG. *3d*, then the car will not be moved. Furthermore, if the displacement angle, after the feeler engagement ball has become seated on the feeler cone, is equal to or less than the null angle, then the car will be considered to be aligned with the charging hole with sufficient accuracy so that no movement of the car to adjust its position will take place. If, however, the device swings past this null angle to some displacement angle such as angle a′, as shown in FIG. *3e*, then by means described in greater detail below, the car will travel in the direction necessary to decrease the displacement angle. When the advancing cone bottoms on the ball, as is shown in FIG. *3f*, expansion of the piston and cylinder combination stops, and the car's instantaneous velocity, neglecting following error, is proportional to the displacement angle. When the displacement angle becomes equal to the null angle, braking effort will be applied as is described below so that the car will stop at a position where its datum line approximates the vertical centerline of the feeler engagement means as is shown in FIG. *3h*. For reasons also described in greater detail below, the instantaneous velocity of the car will be approximately proportional to the distance which the car need travel to come to its final position.

Figure 4:
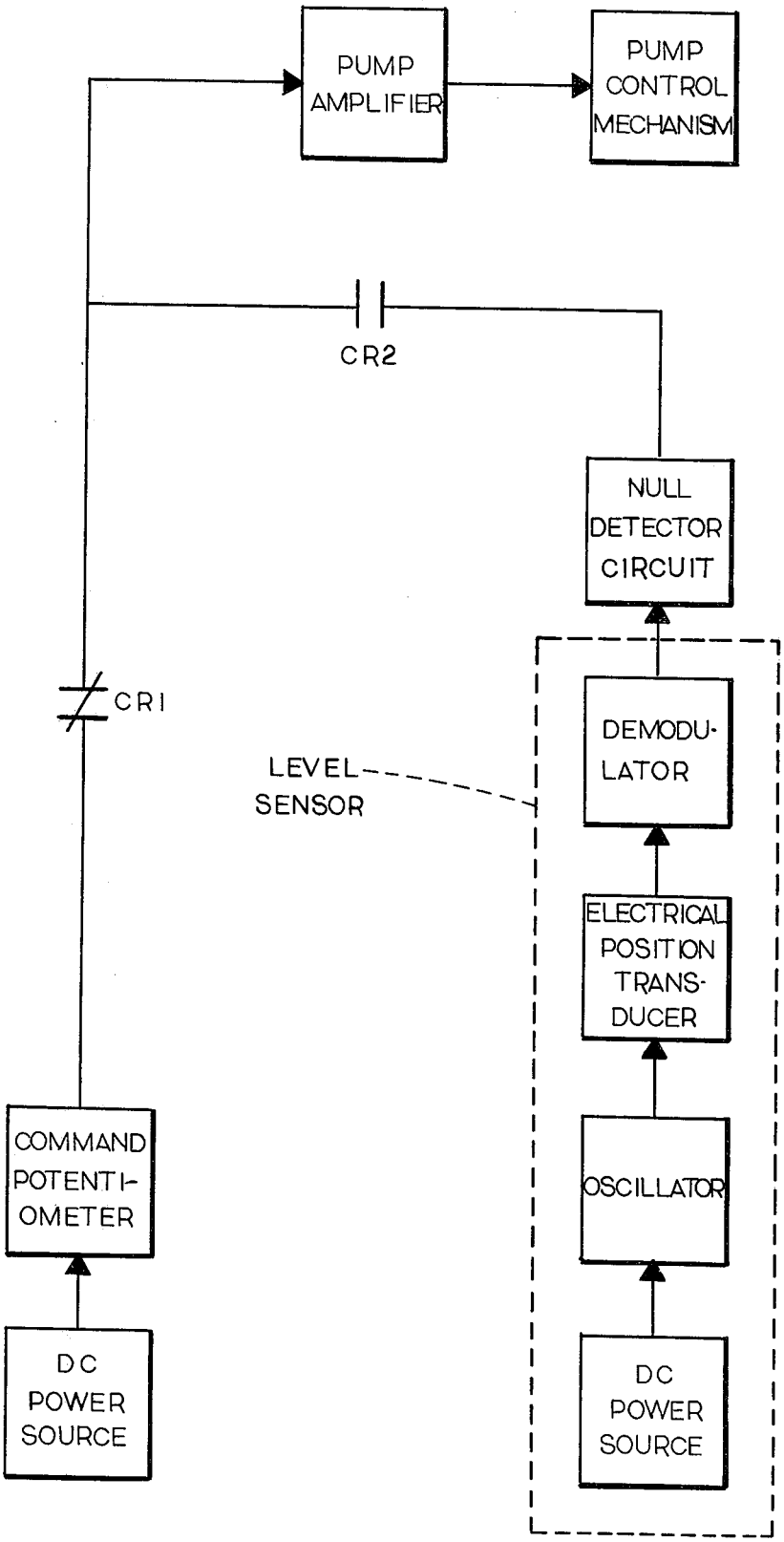
FIG. 4 is a functional block diagram which shows components and further illustrates the operation of the aligning device shown in FIG. 1.

The car is driven by a dual directional, variable speed hydraulic traction drive which is controllable by the operator by means of a command potentiometer. Referring to FIG. 4, it will be seen that by means of the command potentiometer and a direct current power source, the car operator, through a control relay CR1, provides a signal of selectable polarity and amplitude to a pump amplifier circuit which amplifies this signal before it is inputed to a pump control mechanism. This mechanism controls an integral swashplate in a variable displacement hydraulic pump which will either shut off the flow of hydraulic fluid to the traction drive of the car or provide hydraulic fluid flow in a direction which corresponds to the polarity of the signal and in an amount which is proportional to the amplitude or, in other words, the degree to which the operator displaces his potentiometer control to one side or the other. A suitable pump amplifier for use with the apparatus of the present invention is manufactured by Moog Inc. as Model 122–101. A suitable pump control mechanism is the Moog Inc. Model 62–506. A suitable variable displacement hydraulic pump with an integral swashplate may be selected, depending on specific requirements, from the Sundstrand 24 Series. By means of the above described controls the operator initially aligns the feeler cone with the feeler engagement ball as shown in FIG. *3a*. By means of a switch (not shown) the operator then selects an automatic spotting mode by deenergizing control relay CR1 and energizing control relay CR2. It will also be seen from FIG. 4 that this action connects the level sensor with the pump amplifier circuit and the pump control mechanism. This level sensor device includes a direct current power source which is connected with an oscillator which, in turn, is connected with an electrical position transducer that consists of a pendulum supported by bearings and submerged in dampening fluid and appropriate circuitry so that an alternating current output signal is provided, the amplitude of which is proportional to the displacement angle, that is, the angular displacement of the device relative to a gravity vertical reference. This alternating current signal is then inputed to a demodulator which outputs a direct current signal which is also proportional to the displacement angle. A voltage sensory null detector circuit is then provided to eliminate signals which are produced as a result of displacement angles which are equal to or less than the above described null angle. This signal then passes through the control relay CR2 first to the pump amplifier and then to the pump control mechanism. The pump control mechanism operates the swashplate in two directions so that the car will be moved in one direction or the other depending on the polarity of the voltage of the signal. The operation of the swashplate will also be affected by the amplitude of the signal inasmuch as the rate of flow of hydraulic fluid provided to the traction drive will be proportional to the amplitude of the signal. Hence, the instantaneous velocity of the car will be approximately proprotional to the displacement of the device from the vertical reference and, therefore, the distance of the car from its stopping position.

Various other embodiments of the present invention will, from the above description, be apparent to those skilled in the art. For example, it will be appreciated that in a second embodiment of the present invention the position adjusting device described above may be pivotally mounted at a fixed point adjacent the track so as to be engageable with a feeler engagement means mounted on a car.

Figure 5:
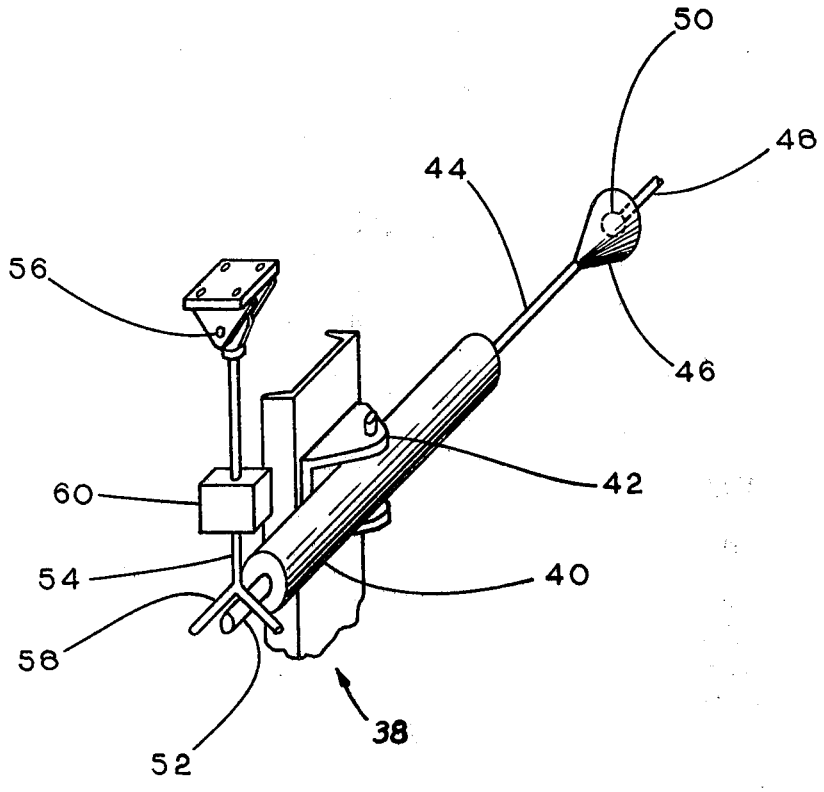
FIG. 5 is a perspective view of another embodiment of the present invention.

A third embodiment of the present invention is shown in FIG. 5 from which it will be seen that the position adjusting device, shown generally at numeral 38, consists of a hydraulic piston and cylinder combination 40 that is pivotally mounted from a track mounted car (not shown) on a trunion bearing 42. The piston and cylinder combination has an extendable horizontal arm 44 which is extended as the piston and cylinder combination is expanded and withdrawn as it is compressed, and at the end of this arm there is a concave, conically-shaped feeler element 46. The feele element 46 is engageable with a fixed, horizontal feeler engagement means 48 that is mounted adjacent the track (not shown) in an elevated position. At its terminal end the feeler engagement means 48 has a ball member 50. The feeler engagement means 48 is positioned so that when its longitudinal centerline corresponds with that of the arm of the position adjusting device, then the track mounted car will be correctly positioned. On the end of the piston and cylinder combination 40 opposite from the arm 44 there is a fork engagement protrusion 52. A vertical arm 54 is suspended from the car on bearing 56 to pivot in a vertical arc parallel to the track. At its lower end the vertical arm has a fork structure 58. A level sensor device 60 is fixed to the arm 54. This level sensor device 60 provides an output direct current electrical signal proportional to angular displacement of the sensor relative to a usually vertical gravity based reference which will preferably be the longitudinal centerline for the pivoting vertical arm when it is suspended in a vertical position. This reference will, in the description of this third embodiment of the present invention, be referred to as the "datum line". The level sensor device 60 will be fixed to the pivoting vertical arm 54 so that its displacement from the datum line will be the same as the angular displacement of the longitudinal centerline of the pivoting vertical arm from the datum line. It will be understood that the frame of reference in which the datum line is defined is that of the car. Thus, this line moves with the car. The operation and components of this level sensor are described in greater detail below. A level sensor which is suitable for use with this embodiment of the device of the present invention is the Moog Inc. Model 133-102. The pivoting vertical anm is, therefore, positioned so that its longitudinal centerline will be perpendicular to that of the piston and cylinder combination 40 and the horizontal arm 44 when the car is correctly positioned and the longitudinal centerline of the piston and cylinder combination 40 and the horizontal arm 44 corresponds with that of the feeler engagement means 48.

The operation of the alignment device 38 is similar to that described above and illustrated in FIGS. *3a–3h* for the alignment device 12. The car is initially spotted by its operator so that the feeler cone element 46 is aligned with the feeler engagement ball 50. In this spotting it is only necessary that some part of the cone be superimposed over the feeler engagement ball. The piston and cylinder combination 40 is then expanded to extend the arm 44. Such extension of the arm 44 will continue until the feeler cone comes into contact with the feeler engagement ball. The hydraulic piston and cylinder combination will continue to expand and further extend the arm so as to move the feeler engagement ball across the inner surface of the feeler element and pivot the piston and cylinder combination in a horizontal arc on the trunion bearing 42 until the feeler engagement ball comes to rest in the central portion of the feeler element. As the piston and cylinder combination 40 and the arm 44 swing horizontally the fork engagement protrustion 52 bears against one side of the fork structure 58 so as to pivot the vertical arm 54 to one side of its original vertical position at the datum line. A displacement angle is established between the datum line and the longitudinal centerline of the pivotally displaced vertical arm 54. A null angle will also be defined as the largest displacement angle which will not result in an adjustment of the car's position. If the displacement angle after the feeler engagement ball has become seated on the feeler cone is equal to or less than the null angle, then the car will be considered to be aligned with the charging hole with sufficient accuracy so that no movement of the car to adjust its position will take place. If, however, the device swings past this null angle, the car will travel in the direction necessary to decrease the displacement angle. When the advancing feeler element bottoms on the ball, expansion of the piston and cylinder combination stops, and the car's instantaneous velocity, neglecting following error, is proportional to the displacement angle. When the displacement angle becomes equal to the null angle, braking effort will be applied so that the car will stop at a position where its datum line approximates the longitudinal centerline of the feeler engagement means 48. As with the first embodiment described above, the car in this third embodiment is driven by a dual directional, variable speed hydraulic traction drive, which is controlled by means of the apparatus described above in connection with FIG. 4.

The present invention also encompasses another, fourth embodiment. With reference to FIG. 5 and the above description of the third embodiment, it will be understood that in this fourth embodiment the feeler engagement means 48 may be mounted on the moveable car while the piston and cylinder combination 40 may be mounted at a fixed position adjacent the truck. The vertical arm 54 may also be pivotally mounted on the car or in a fixed position adjacent the track.

It will, thus, be appreciated that there has been described a device for accurately stopping a track mounted car at a particular position without oscillating the car about that position. Although the invention has been described with a certain degree of particularlity, it is to be understood that the present disclosure has been made only as an example and that the scope of the invention is defined by what is claimed hereafter.

What is claimed is:

1. A track mounted car, track and a device for moving the track mounted car from an initial spotted position on said track to a second predetermined position on said track comprising:

(a) an arm member having a terminal feeler means and being pivotally mounted on said car so as to be oscillatory in a vertical arc generally parallel to said track;

(b) sensing means for providing an electrical output signal related in polarity and proportional in amplitude to angular displacements of the arm member in its vertical arc from a gravity based reference position of the arm member in said vertical arc;

(c) a protrusion engageable with said feeler means and positioned remotely from the car and in fixed relation to the track so that when the feeler means and the protrusion are engaged and the car has reached its second predetermined position, the arm member will be positioned in its gravity based reference position;

(d) a dual directional, variable speed drive means for moving the car on the track; and (e) control means for operating said drive means in a direction dependent on the polarity of said signal and at a speed proportional to the amplitude of said signal, such that the car will move to said second predetermined position at an instantaneous velocity which is approximately proportional to its remaining distance from said second position.

2. A track mounted car, track and a device for moving the track mounted car from an initial spotted position on said track for a second predetermined position on said track comprising:

(a) an arm member having a terminal feeler means and being pivotally mounted and positioned remotely from said car and in fixed relation to the track so as to be oscillatory in a vertical arc generally parallel to the track;

(b) sensing means for providing an electrical output signal related in polarity and proportional in amplitude to angular displacements of the arm member in its vertical arc from a gravity based reference position of the arm member in said vertical arc;

(c) a protrusion engageable with said feeler means and mounted on said car so that when the feeler means and the protrusion are engaged and the car has reached its second predetermined position, the arm member will be positioned in its gravity based reference position;

(d) a dual directional, variable speed drive means for moving the car on the track; and (e) control means for operating said drive means in a direction dependent on the polarity of the signal and at a speed proportional to the amplitude of said signal, such that the car will be moved to said second predetermined position at an instantaneous veloicty which is approximately proportional to its remaining distance from said second position.

3. The device as defined in claim 1 or 2 wherein means are provided to extend the arm member to place the feeler means into engagement with the protrusion.

4. The device as defined in claim 1 wherein a hydraulic piston and cylinder combination is pivotally mounted on said car and the arm member extends therefrom and is extended by expansion of said piston and cylinder combintation.

5. The device as defined in claim 4 wherein the hydraulic piston and cylinder combination is suspended beneath the car and is mounted on a spherical bearing.

6. The device as defined in claim 2 wherein a hydraulic piston and cylinder combination is pivotally mounted and positioned remotely from said car and in fixed relation to said track and the arm member extends therefrom and is extended by expansion of said piston and cylinder combination.

7. The device as defined in claim 1 or 2 wherein said sensing means includes means for establishing the gravity based reference position as a vertical position.

8. The device as defined in claim 1 or 2 wherein the feeler means and the protrusion are engageable in convex and concave relation.

9. The device as defined in claim 8 wherein the feeler means is concave and cone-shaped and the protrusion is terminally ball-shaped.

10. The device as defined in claim 1 or 2 wherein said sensing means for providing an electrical output signal consists of a direct current power source, an oscillator, an electrical position transducer, and a demodulator.

11. The device as defined in claim 1 or 2 wherein a circuit is provided to eliminate signals which result from displacements of the arm member from its gravity based reference position which are equal to or less than a preselected null angle.

12. The device as defined in claim 1 or 2 wherein the drive means is a hydraulic traction drive.

13. A track mounted car, track and a device for moving the track mounted car from an initial spotted position on said track to a second predetermined position on said track comprising:

(a) a generally vertical arm member pivotally mounted at its one end so as to be oscillatory in a vertical arc generally parallel to said track;

(b) sensing means for providing an electrical output signal related in polarity and proportional in amplitude to angular displacements of the vertical arm member in its vertical arc from a gravity based reference position of the arm member in said vertical arc;

(c) a generally horizontal arm member having a terminal feeler means and being pivotally mounted on the car so as to be oscillatory in a horizontal arc;

(d) connecting means for displacing said vertical arm member in its vertical arc when said horizontal arm member is displaced in its horizontal arc;

(e) a protrusion engageable with said horizontal arm member feeler means and positioned remotely from the car and in fixed relation to the track so that when the feeler means and the protrusion are engaged and the car has reached its second predetermined position, the vertical arm member will be positioned in its gravity based reference position;

(f) a dual directional, variable speed drive means for moving the car on the track; and (g) control means for operating said drive means in a direction dependent on the polarity of said signal and at a speed proportional to the amplitude of said signal, such that the car will move to said seond predetermined position at a instantaneous velocity which is approximately proportional to its remaining distance from said second position.

14. A track mounted car, track and a device for moving the track mounted car from an initial spotted position on said track to a second predetermined positioned on said track comprising:

(a) a generally vertical arm member pivotally mounted at its one end so as to be oscillatory in a vertical arc generally parallel to said track;

(b) sensing means for providing an electrical output signal related in polarity and proportional in amplitude to angular displacements of the vertical arm member in its vertical arc from a gravity based reference position of the arm member in said vertical arc;

(c) a generally horizontal arm member having a terminal feeler means and being pivotally mounted and positioned remotely from said car and in fixed relation to the track so as to be oscillatory in a horizontal arc;

(d) connecting means for displacing said vertical arm member in its vertical arc when said horizontal arm member is displaced in its horizontal arc;

(e) a protrusion engageable with said horizontal arm member feeler means and mounted on said car so that when the feeler means and the protrusion are engaged and the car has reached its second predetermined position, the vertical arm member will be positioned in its gravity based reference position;

(f) a dual directional, variable speed drive means for moving the car on the track; and (g) control means for operating said drive means in a direction dependent on the polarity of said signal and at a speed proportional to the amplitude of said signal, such that the car will move to said second predetermined position at an instantaneous velocity which is approximately proportional to its remaining distance from said second position.

15. The device as defined in claim 13 or 14 wherein means are provided to extend the horizontal arm member to place the feeler means into engagement with the protrusion.

16. The device as defined in claim 13 wherein a horizontal hydraulic piston and cylinder combination is mounted on the car to pivot on its vertical axis and the horizontal arm member extends therefrom and is extended by expansion of said piston and cylinder combination.

17. The device as defined in claim 14 wherein a horizontal hydraulic piston and cylinder combination is mounted remotely from said car and in fixed relation to said track to pivot on its vertical axis and the horizontal arm member extends therefrom and is extended by expansion of said piston and cylinder combination.

18. The device as defined in claim 13 or 14 wherein said sensing means includes means for establishing the gravity based reference position as a vertical position.

19. The device as defined in claim 13 or 14 wherein the feeler means and the protrusion are engageable in convex and concave relation.

20. The device as defined in claim 19 wherein the feeler means is concave and cone-shaped and the protrusion is terminally ball-shaped.

21. The device as defined in claim 13 or 14 wherein said sensing means for providing an electrical output signal consists of a direct current power source, an oscillator, an electrical transducer, and a demodulator.

22. The device as defined in claim 13 or 14 wherein a circuit is provided to eliminate signals which result from displacements of the vertical arm member from its gravity based reference position which are equal to or less than a preselected null angle.

23. The device as defined in claim 13 or 14 wherein the drive means is a hydraulic traction drive.

24. The device as defined in claim 13 or 14 wherein the vertical arm member is pivotally mounted on the car.

25. The device as defined in claim 13 or 14 wherein the vertical arm member is pivotally mounted remotely from the car and in fixed relation to the track.

26. The device as defined in claim 1, 2, 13 or 14 wherein the car is a piece of rail mounted coke oven auxiliary equipment.

* * * * *